United States Patent [19]

Takigawa

[11] Patent Number: 5,010,648

[45] Date of Patent: Apr. 30, 1991

[54] GRAY HAIR CUTTER

[75] Inventor: Koichi Takigawa, Tokyo, Japan

[73] Assignee: Takigawa Kabushiki Kaisha, Tokyo, Japan

[21] Appl. No.: 445,559

[22] Filed: Dec. 4, 1989

[30] Foreign Application Priority Data

Feb. 27, 1989 [JP] Japan ..... 1-20303[U]

[51] Int. Cl.[5] ..... B26B 19/22; B26B 29/00; B26B 27/00; A45D 29/00

[52] U.S. Cl. ..... 30/195; 30/28; 30/294; 30/298

[58] Field of Search ..... 30/28, 294, 293, 290, 30/295, 298, 291, 195

[56] References Cited

U.S. PATENT DOCUMENTS

| | | | |
|---|---|---|---|
| 1,085,569 | 1/1914 | Casse | 30/28 |
| 1,445,667 | 2/1923 | Dearholt | 30/294 |
| 1,996,261 | 4/1935 | Storz | 30/294 |
| 3,439,420 | 4/1969 | Erickson | 30/294 |
| 3,529,352 | 9/1970 | Pantages | 30/298 |
| 3,888,006 | 6/1975 | Roberts | 30/298 |
| 4,020,550 | 5/1977 | Okada | 30/294 |

FOREIGN PATENT DOCUMENTS

| | | | |
|---|---|---|---|
| 677862 | 3/1930 | France | 30/294 |
| 965628 | 9/1950 | France | 30/294 |
| 1074287 | 10/1954 | France | 30/294 |
| 379828 | 8/1964 | Switzerland | 30/298 |
| 1367978 | 9/1974 | United Kingdom | 30/294 |

*Primary Examiner*—Douglas D. Watts
*Assistant Examiner*—Paul M. Heyrana, Sr.
*Attorney, Agent, or Firm*—John E. Reilly

[57] ABSTRACT

A gray hair cutter is disclosed which comprises an operating member having a curved free end serving as a hook provided with a cutting edge. The cutting edge may be fixed or pivoted for movement through a slot to reliably cut a single gray hair selected from among many hairs.

6 Claims, 3 Drawing Sheets

GRAY HAIR CUTTER

This invention relates to cutter blades; and more particularly a manually operated cutter for gray hairs.

BACKGROUND AND FIELD OF THE INVENTION

Heretofore, there has been no gray hair cutter for cutting gray hairs found in the scalp, eyebrows or nose. For example, nose hair scissors or the like are used to cut a selected hair by pulling the hair with fingertips. However, since there are many hairs grown in an intricate fashion in the scalp, it is very difficult to cut a single hair reliably with scissors, and nearby normal hairs are often cut as well.

SUMMARY OF THE INVENTION

This invention has been intended in light of the above and its object is to provide a gray hair cutter which can reliably cut a single gray hair selected from among many hairs.

According to the invention, there is provided a gray hair cutter comprising an operating member having a curved free end serving as a hook which is provided with a cutting edge.

Also, there is provided a gray hair cutter comprising a case and an operating member rotatably accommodated in the case to be stored in and taken out from the case, the operating member being provided with a beak-like free end and a guide facing the beak-like free end and provided with a cutting edge.

Further there is provided a gray hair cutter comprising a grip and an operating member having a suitable length and extending from an end of the grip, the operating member being provided with a beak-like free end and a guide facing the beak-like free end and provided with a cutting edge.

Further there is provided a gray hair cutter comprising an operating member having a slanted concave guide open at one edge and defined by an upper jaw and a lower jaw, the lower jaw having an inner narrow space, a cutting blade extending in the inner narrow space and having a projection at one side and penetrating a slot formed in a sidewall of the operating member, the cutting blade being capable of being projected into and retreated from the guide by moving the projection along the slot.

Further, there is provided a gray hair cutter comprising a grip, a flat case provided on an end of the grip and having a V-shaped opening provided at the free end and scissors pivotal across opposite sidewalls of the case such that their cutting edges face the center of the V-shaped opening, and respective handle portions of the scissors penetrate opposite edges of the case.

Further, there is provided a cutter comprising a grip, an operating member provided on an end of the grip and a beak-shaped free end portion having a concave inner edge, a cutting blade pivoted by a pin to the operating member and facing the concave inner edge, and an operating bar linked to the pin and extending into an inner space in the grip, the operating bar having an urging member projecting from the end opposite the beak-shaped free end portion and penetrating the grip to the outside.

Further, there is provided a gray hair cutter having a pincer-like structure consisting of two elastic members having respective bent head portions, one of the bent head portions being in contact with the outer surface of the other bent head portion and being provided with a cutting edge.

The above and other objects, advantages and features of the present invention will become more readily appreciated and understood from a consideration of the following detailed description of preferred and modified forms of the present invention when taken together with the accompanying drawings in which:

DETAILED DESCRIPTION OF THE PREFERRED EMBODIMENT

Figure 1:
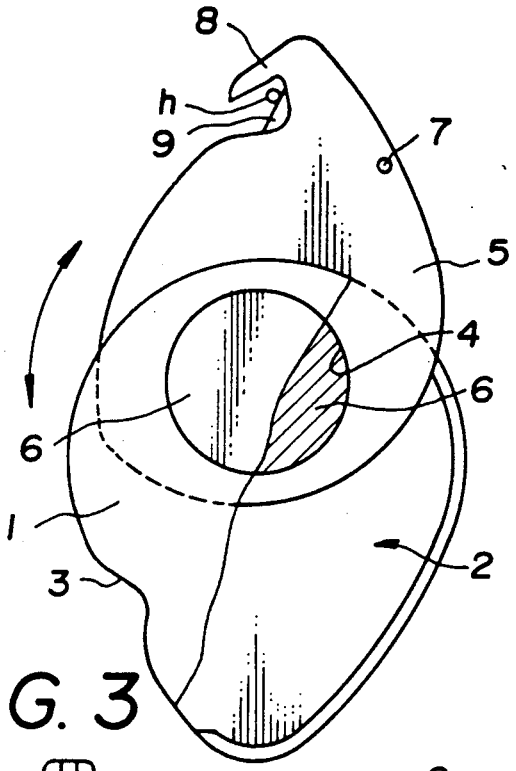
FIG. 1 is a front view, partly broken away, showing a first embodiment of the invention in use.
Figure 3:
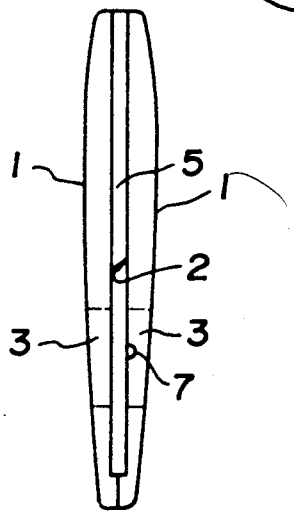
FIG. 3 is a left side view showing the same.
Figure 2:
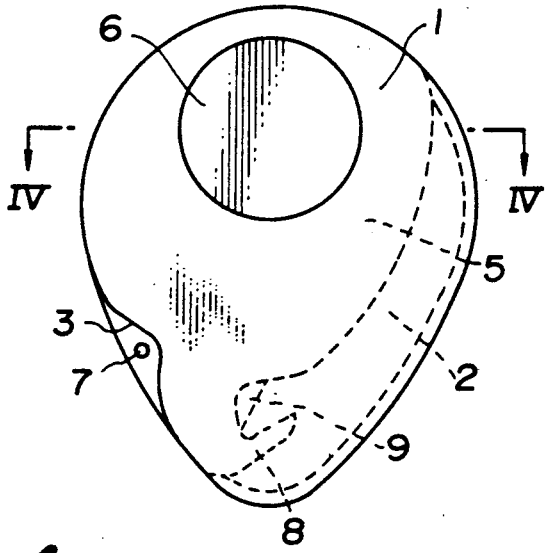
FIG. 2 is a front view showing the same in a stored position.
Figure 4:
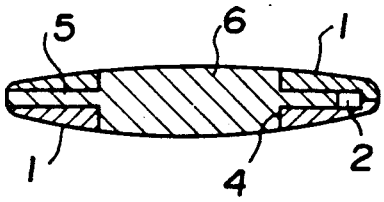
FIG. 4 is a sectional view taken along lines IV—IV in FIG. 2.

The invention will now be described in conjunction with preferred embodiments thereof with reference to the drawings.

Referring to the drawings, there is illustrated in FIGS. 1 to 4 a gray hair cutter having a construction such that an operating member having a cutting edge is rotatable with respect to a case for accommodating it therein, and taking out therefrom.

Reference numeral 1 designates a case having opening 2 formed along part of its edge. Opposite sidewalls of the case have respective depressions 3 formed along part of opening 2, and also have respective holes 4 formed in an upper portion. An operating member 5 is rotatably mounted in case 1 with oposite side ear portions 6 received in holes 4 of the opposite sidewalls of case 1. When operating member 5 is rotatably inserted in the case 1, it is partly exposed in the depressions 3 of case 1 formed along opening 2 thereof. The member 6 has projections 7 provided on the opposite sides of its exposed portions and has a hook 8 formed at its free end. Hook 8 has a beak-like end portion, and its inner straight edge is provided with cutting edge 9.

In use, the operating member 5 is rotated out of the case 1 and turned by about 180° to an operative position as shown in FIG. 1 by applying fingers to opposite side projections 7 provided on the exposed portion. The cutting edge 9 of hook 8 is applied to the stem of a gray hair (h) which is held with the fingers, and force is applied to member 5 to cut the hair.

Figure 5:
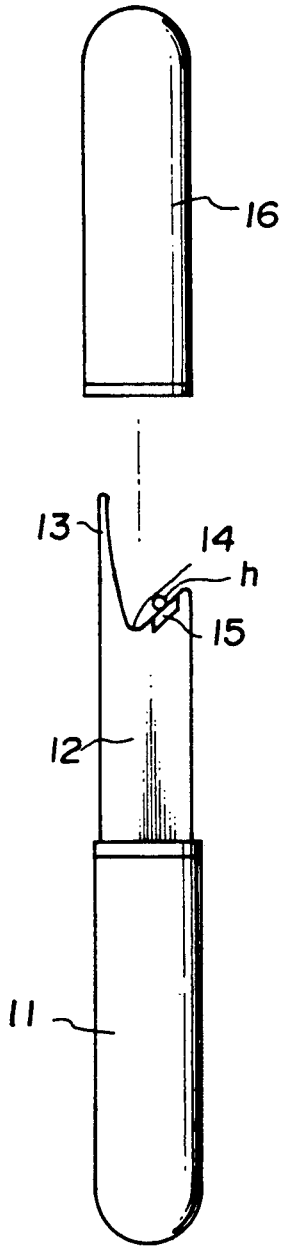
FIG. 5 is a front view showing a second embodiment of the invention in a stored position.
Figure 6:
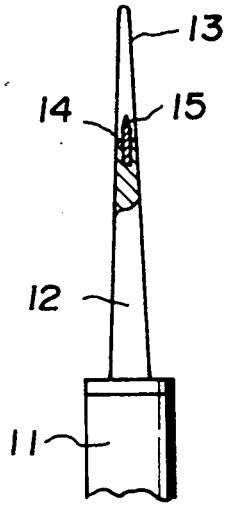
FIG. 6 is a side view, partly broken away, showing the second embodiment in use.
Figure 7:
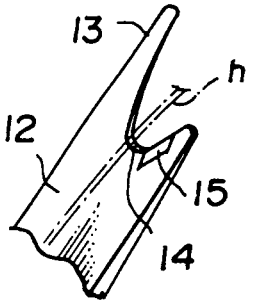
FIG. 7 is a fragmentary perspective view showing the cutting end of the second embodiment.

In the embodiment of FIGS. 5 to 7, an operating member 12 having a cutting edge 15 is mounted in a grip 11. The operating member 12 is elongated and is secured to an end of the grip 11. The operating member 12 has a portion 13 formed at the free end which is beak-like and has a concave edge 14. The concave edge is generally V-shaped with longer and shorter portions extending from the member 12. A cutting edge 15 is provided on the shorter portion of the concave edge 14, and the longer portion of the concave edge 14 serves as a guide. A cap 16 can be fitted to cover operating member 12.

In use, the longer hook portion 13 of the operating member 12 serves as a guide, the cutting edge 15 is brought to a hair (h) held between the fingertips, and a force is applied to operating member 12 to cut the hair (h).

Figure 8:
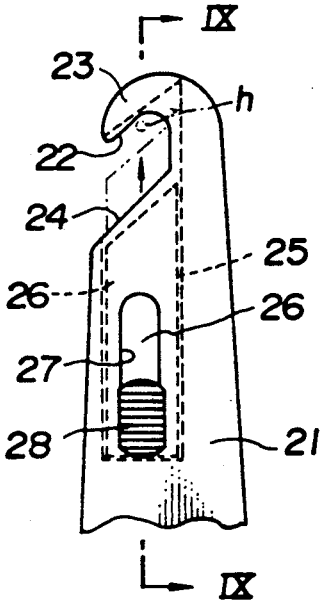
FIG. 8 is a fragmentary front view showing a third embodiment of the invention.
Figure 9:
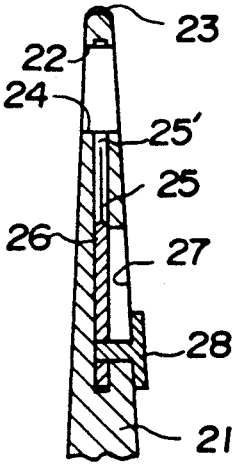
FIG. 9 is a sectional view taken along lines IX—IX of FIG. 8.

In the embodiment of FIGS. 8 and 9, a cutting blade 26 is reciprocated relative to an operating member 21. The operating member 21 has a hook-shaped end portion or guide 22 formed adjacent to its free end. The hook portion 22 is slanted and open at one edge to define outer and inner jaws 23 and 24. The inner jaw 24 has a narrow inner slot 25 extending longitudinally to receive a cutting blade 25 extending longitudinally to receive a cutting blade 26. The cutting blade 26 has a slanted cutting edge extending through open end 25' of the space 25 in the inner jaw 24. The operating member 21 has a slot 27 formed on one side and communicating with the space 25. The cutting blade 26 can be moved toward and away from the outer jaw 23 by applying a force to a thumb button 28 projecting from the blade 26 through a slot 27 in the side of the member 21.

In use, the cutting blade 26 is normally retracted into the inner jaw 24. Then the inner edge of outer jaw 23 is applied to a gray hair (h) pinched between the fingertips, and the cutting blade 26 is pushed toward the outer jaw 23 by applying a force to button 28, thus cutting the hair. Afterwards, cutting blade 26 is retracted again into the space 25 by force applied to the button 28.

Figure 10:
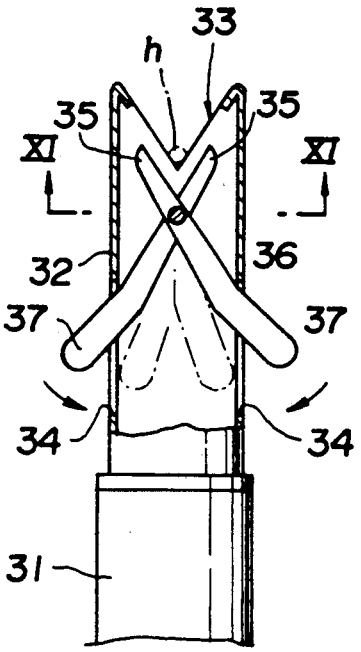
FIG. 10 is a front view, partly broken away, showing a fourth embodiment of the invention.
Figure 11:
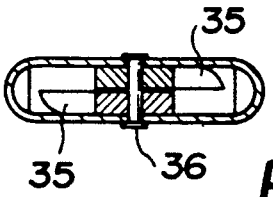
FIG. 11 is a cross-sectional view taken along lines XI—XI of FIG. 10.

In the embodiment of FIGS. 10 and 11, a hair cutter includes cutting scissors 35 mounted in a case 32 to cut hair by lateral motion of the scissors 35. A grip 31 has a flat box-like case 32 secured at one end. The outer end of the case 32 has a V-shaped opening 33, and opposite sidewalls of the case are formed with holes or slots 34 in an inner portion. The scissors 35 are pivoted by pin 36 to the case 32 at a position below inwardly of the top opening 33. The cutting edges of the scissors face the center of the opening 33. The scissors 35 are operated with fingers applied to their handles 37 projecting from the opposite slots 34 of the case 32.

In use, a gray hair (h) is held by the fingertips in the V-shaped guide constituted by the opening 33 of the case 32, and the scissors 35 are operated by manual pressure applied to handles 37 to cut the hair (h).

Figure 12:
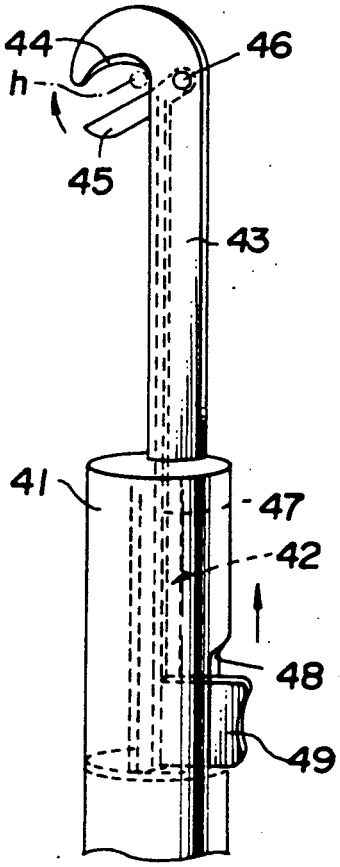
FIG. 12 is a fragmentary sectional view showing a fifth embodiment of the invention.

In the embodiment of FIG. 12, a cutting blade 45 is operated vertically with respect to a hook-shaped guide 44 at the free end of an operating member 43 to cut a hair. A grip 41 includes an inner longitudinal space or bore 42. The lower end of the operating member 43 is secured to the grip 41. The operating member 43 has a hook-shaped end with an inner concave blade 44, and a cutting blade 45 is disposed beneath and faces the guide 44. The stem of the cutting blade 45 is pivoted by pin 46 to the operating member 43. To pin 46 is coupled the upper end of operating bar or rod 47 extending through the longitudinal bore 42 in the grip 41 and along one side of the operating member 43. The operating bar 47 has a lateral flange 48 projecting from the lower end through an elongated slot 48 formed in the peripheral wall of the grip 41.

In use, the concave inner guide 44 of the hook-shaped end of operating member 43 is placed in surrounding relation to a gray hair (h), and the flange 49 is pushed up with the thumb of the other hand than that gripping the grip. The cutting blade 45 thus is vertically moved via operating bar 47 and pin 46 to cut the hair.

Figure 13:
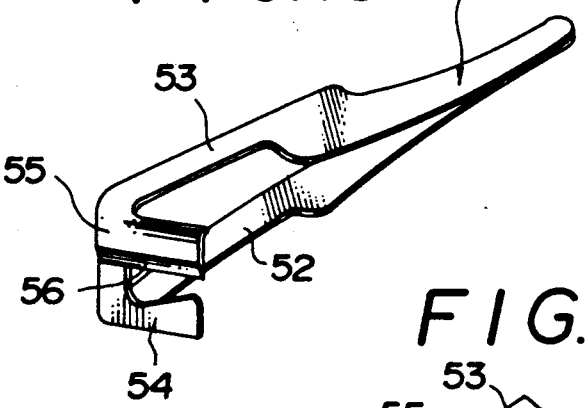
FIG. 13 is a perspective view showing a sixth embodiment.
Figure 14:
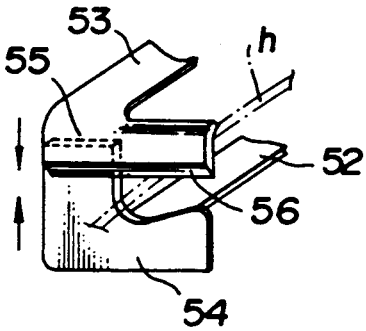
FIG. 14 is an enlarged perspective view showing the cutting end of FIG. 13.

In the embodiment of FIGS. 13 and 14, a cutting edge is operated in the manner of a pincer to cut a gray hair. The pincer is defined by flat elongated spring-like members 52 and 53 joined together at a common end. The members 52 and 53 diverge forwardly, the member 52 having a bent head portion 54 forming a hook or L-shaped guide. The elastic member 53 also has a hook or bent head portion 55 which can be moved in frictional contact with the outer surface of the head portion 54 of the member 52. The head portion 55 is provided with a cutting edge 56.

In use, a gray hair (h) is held between the fingertips and is applied to the corner of the L-shaped guide of head portion 54 of the member 52, and the two elastic members 52 and 53 are urged or squeezed toward each other. As a result, the hair is cut by the cutting edge 56 provided on head portion 55.

As has been described in the foregoing, the cutter according to the invention is used by gripping it with one hand and inserting it into the hair on the scalp, holding a gray hair taut with the other hand, then applying the guide 54 of the cutter to the stem of the gray hair and cutting the hair. Thus, it is possible to cut only a gray hair perfectly separately from the rest of the hair, and the operation of cutting a gray hair can be done reliably and quickly.

It is therefore to be understood from the foregoing that various modifications and changes may be made in the construction and arrangement of elements comprising the present invention without departing from the spirit and scope of the present invention as defined by the appended claims and reasonable equivalents thereof.

I claim:

1. A device for cutting gray hairs comprising a grip, and an operating member extending from said grip, said operating member including a generally hook-shaped end portion provided with an open slot therein having coplanar opposed facing surface portions defining an entrance therebetween for insertion of a hair to be cut, and a cutting edge extending along one of said surface portions of said slot in facing relation to the other of said surface portions and being disposed in the plane of said surface portions, said grip including a storage area and said operating member including means mounting said operating member for movement between a position within said storage area and an extended position away from said storage area.

2. A device according to claim 1, said operating member being of slender, elongated configuration and said hook-shaped free end including a curved free end portion extending transversely of the length of said operating member.

3. A gray hair cutting device comprising an operating member having a slanted concave guide portion open at one end and defined by an outer jaw and an inner jaw, said inner jaw having a slot therein, a cutting blade extending into said slot and having means projecting from one side through a slot formed in a sidewall of said operating member for advancing and retreating said cutting blade toward and away from said outer jaw.

4. A gray hair cutter comprising a grip, a flat case having opposite sidewalls and a V-shaped opening provided at a free end of said case having inclined edges diverging away from an inner closed end of said opening and scissors pivoted to the opposite sidewalls of said case in closely spaced relation to said inner closed end including mutually opposed cutting edges facing the center of said V-shaped opening and having respective handle gripping means extending beyond opposite edges of said case for pivoting said cutting edges across said inner closed end for cutting a hair inserted therein.

5. A gray hair cutter comprising a grip, an operating member at one end of said grip and a hook-shaped, rigid free end portion having a concave inner edge, a cutting blade and means including a pin pivotally connecting said blade to said operating member in facing relation to said concave inner edge, and an operating bar linked to said pin and extending into an inner space in said grip, said operating bar having means projecting from said grip for urging said cutting blade against said concave inner edge.

6. A gray hair cutter having a pincer-like structure consisting of two spring-like members having respective bent head portions, one of said bent head portions being in contact with the outer surface of the other bent head portion and including a cutting edge in overlapping relation to the other bent head portion, said other bent head portion including guide means for insertion of a gray hair to be cut by said cutting edge.

* * * * *